US005909737A

United States Patent [19]

Ricco

[11] Patent Number: 5,909,737

[45] Date of Patent: Jun. 8, 1999

[54] COMBINATION BRUSH AND HAIRSPRAY SYSTEM

[76] Inventor: Johnny Ricco, 401 W. 56th St., Apt. 4K, New York, N.Y. 10019

[21] Appl. No.: 09/087,040

[22] Filed: May 29, 1998

Related U.S. Application Data

[60] Provisional application No. 60/064,646, Nov. 10, 1997.

[51] Int. Cl.[6] ..... A45D 24/22

[52] U.S. Cl. ..... 132/116; 132/112

[58] Field of Search ..... 132/112, 113, 132/120, 124, 119.1, 114, 116; 401/184, 190, 186, 270, 277, 281, 28, 138; 222/397, 191, 195

[56] References Cited

U.S. PATENT DOCUMENTS

| | | | |
|---|---|---|---|
| 2,031,774 | 2/1936 | Helfrich | 132/112 |
| 2,228,213 | 1/1941 | Hillsberry | 132/116 |
| 3,606,555 | 9/1971 | Ferro | 132/112 |
| 3,721,250 | 3/1973 | Walter et al. | 132/112 |
| 4,254,738 | 3/1981 | Stanley | 132/112 |
| 4,557,619 | 12/1985 | DeVincentis | 401/190 |
| 4,858,600 | 8/1989 | Gross et al. | 128/65 |
| 4,938,621 | 7/1990 | Pyrozyk | 401/289 |
| 5,297,882 | 3/1994 | Kornides | 401/184 |
| 5,622,192 | 4/1997 | Chiou | 132/112 |

*Primary Examiner*—Gene Mancene
*Assistant Examiner*—Pedro Philogene
*Attorney, Agent, or Firm*—Michael S. Neustel

[57] ABSTRACT

A combination brush and hairspray system for allowing a user to simultaneously brush and apply hairspray to their hair with only one hand. The inventive device includes a head supporting a plurality of bristles, a handle attached to the head, a chamber within the handle, a pump within the head or handle fluidly connected to the chamber, a plurality of delivery tubes fluidly connected to the pump opposite of the chamber, and a corresponding plurality of nozzles positioned within the head facing the bristles fluidly connected to the delivery tubes. The user fills the chamber with a fluid such as hairspray, gel, water or conditioner, and then brushes their hair. While brushing their hair, the user manipulates the pump so as to draw the fluid from the chamber and into the delivery tubes where the fluid is emitted through the plurality of nozzles into the user's hair. The user may also utilize a conventional hairdryer while applying the fluid to achieve the desired texture of the hair normally unattainable by conventional devices and methods.

8 Claims, 5 Drawing Sheets

COMBINATION BRUSH AND HAIRSPRAY SYSTEM

CROSS-REFERENCE TO PROVISIONAL PATENT APPLICATION

This application is a continuation of provisional application Ser. No. 60/064,646 filed Nov. 10, 1997, entitled Hairbrush.

BACKGROUND OF THE INVENTION

1. Field of the Invention

The present invention relates generally to hairbrush devices and more specifically it relates to a combination brush and hairspray system for allowing a user to simultaneously brush and apply hairspray to their hair with only one hand.

2. Description of the Prior Art

Conventional hairbrush devices have been utilized for years. Conventional hairbrushes typically have a handle, a head and a plurality of bristles extending from the head. The user manipulates the handle so as to engage the bristles with the user's hair. Most users will blow-dry their hair simultaneously while brushing so as to style their hair.

The problem with conventional hairbrushes is that the user must disengage the hairdryer from their hand to be able to grasp a separate hairspray container before applying hairspray to their hair. This can be cumbersome and can be dangerous if the hairdryer is dropped within water while attempting to hurriedly grasp the hairspray container. Further, the hairspray container generally creates a mist of hairspray which is likely to engage the user's eyes. Additionally, the user is unable to utilize the hairdryer simultaneously while applying the hairspray.

Examples of hairbrush devices include U.S. Pat. No. 4,254,738 to Stanley; U.S. Pat. No. 3,973,853 to Myers; U.S. Design Pat. No. 270,427 to Henington; U.S. Pat. No. 4,557,619 to DeVincentis which are all illustrative of such prior art.

Stanley (U.S. Pat. No. 4,254,738) discloses a pet brush which has an L-shaped case with a partially hollow interior for housing a container of grooming solution and a brush attached thereto. The container typically has a spray attachment which sprays the grooming solution into a chamber which evenly distributes the solution across the full bristle patter of the brush.

Henington (U.S. Design Pat. No. 270,427) discloses a combination hairbrush and pump sprayer. Henington teaches a brush having a handle and a head, a pump spray nozzle attached to the head with a tube extending into the brush to engage a reservoir within the handle and head.

While these devices may be suitable for the particular purpose to which they address, they are not as suitable for allowing a user to simultaneously brush and apply hairspray to their hair with only one hand.

In these respects, the combination brush and hairspray system according to the present invention substantially departs from the conventional concepts and designs of the prior art, and in so doing provides an apparatus primarily developed for the purpose of allowing a user to simultaneously brush and apply hairspray to their hair with only one hand.

SUMMARY OF THE INVENTION

A primary object of the present invention is to provide a combination brush and hairspray system that will overcome the shortcomings of the prior art devices.

Another object is to provide a combination brush and hairspray system that allows the user to simultaneously apply hairspray to their hair while brushing their hair.

An additional object is to provide a combination brush and hairspray system that allows the user to have a free hand while applying brushing and applying hairspray.

A further object is to provide a combination brush and hairspray system that is capable of applying hair spray near the base portion of the hair.

Another object of the present invention is to provide a combination brush and hairspray system which provides minimal waste of hairspray.

A further object of the present invention is to provide a combination brush and hairspray system which reduces the amount of hairspray floating within the air during application of hairspray.

A further object of the present invention is to provide a combination brush and hairspray system eliminates the need for the user to physically apply gel or mousse to their hands for application to their hair.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
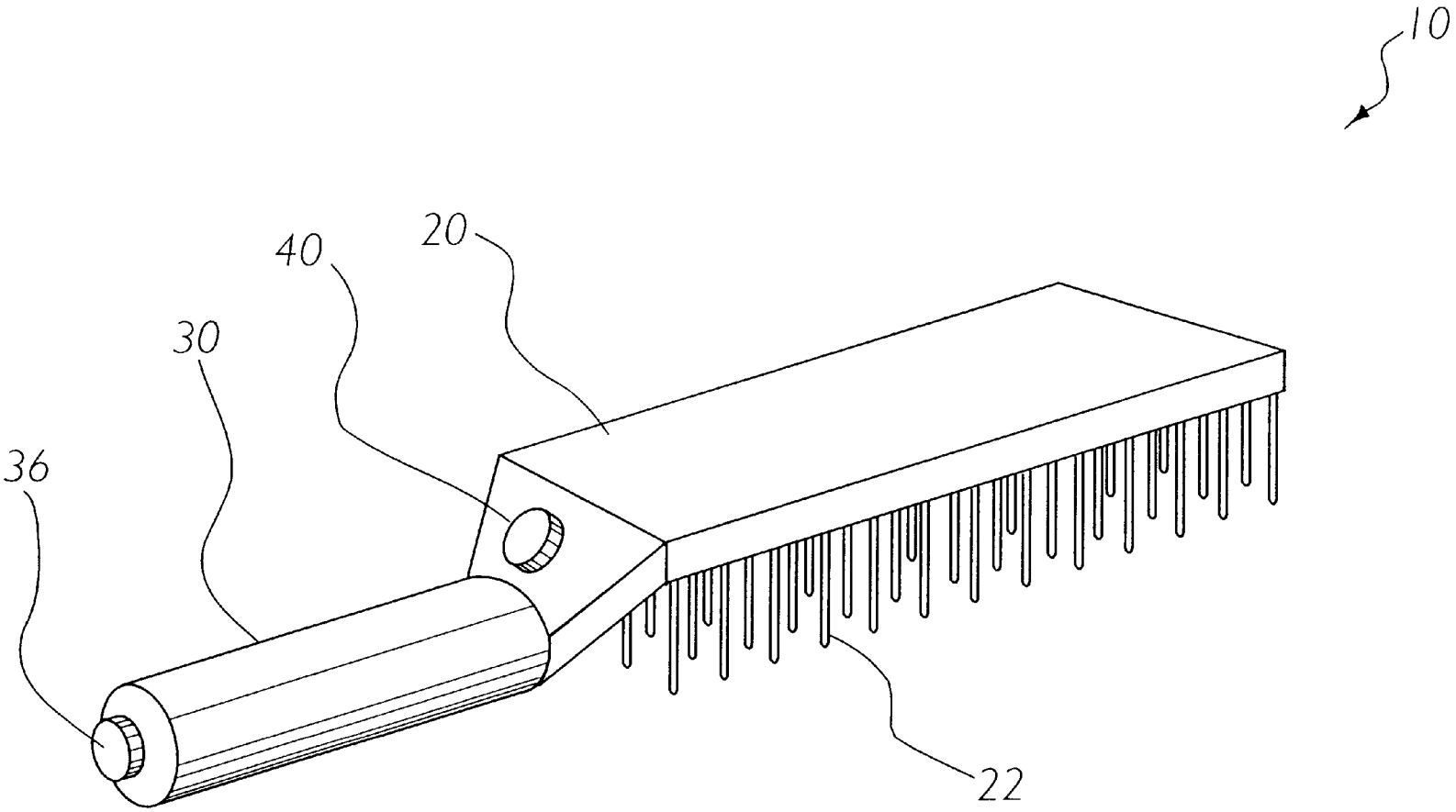
FIG. 1 is an upper rear perspective view of the present invention.

Turning now descriptively to the drawings, in which similar reference characters denote similar elements throughout the several view, FIGS. 1 through 4 illustrate a combination brush and hairspray system 10, which comprises a head 20 supporting a plurality of bristles 22, a handle 30 attached to the head 20, a chamber 34 within the handle 30, a pump 42 within the head 20 or handle 30 fluidly connected to the chamber 34, a plurality of delivery tubes 46 fluidly connected to the pump 42 opposite of the chamber 34, and a corresponding plurality of nozzles 24 positioned within the head 20 facing the bristles 22 fluidly connected to the delivery tubes 46. The user fills the chamber 34 with a fluid such as hairspray, gel, water or conditioner, and then brushes their hair. While brushing their hair, the user manipulates the pump 42 so as to draw the fluid from the chamber 34 and into the delivery tubes 46 where the fluid is emitted through the plurality of nozzles 24 into the user's hair. The user may also utilize a conventional hairdryer while applying the fluid to achieve the desired texture of the hair normally unattainable by conventional devices and methods.

Figure 2:
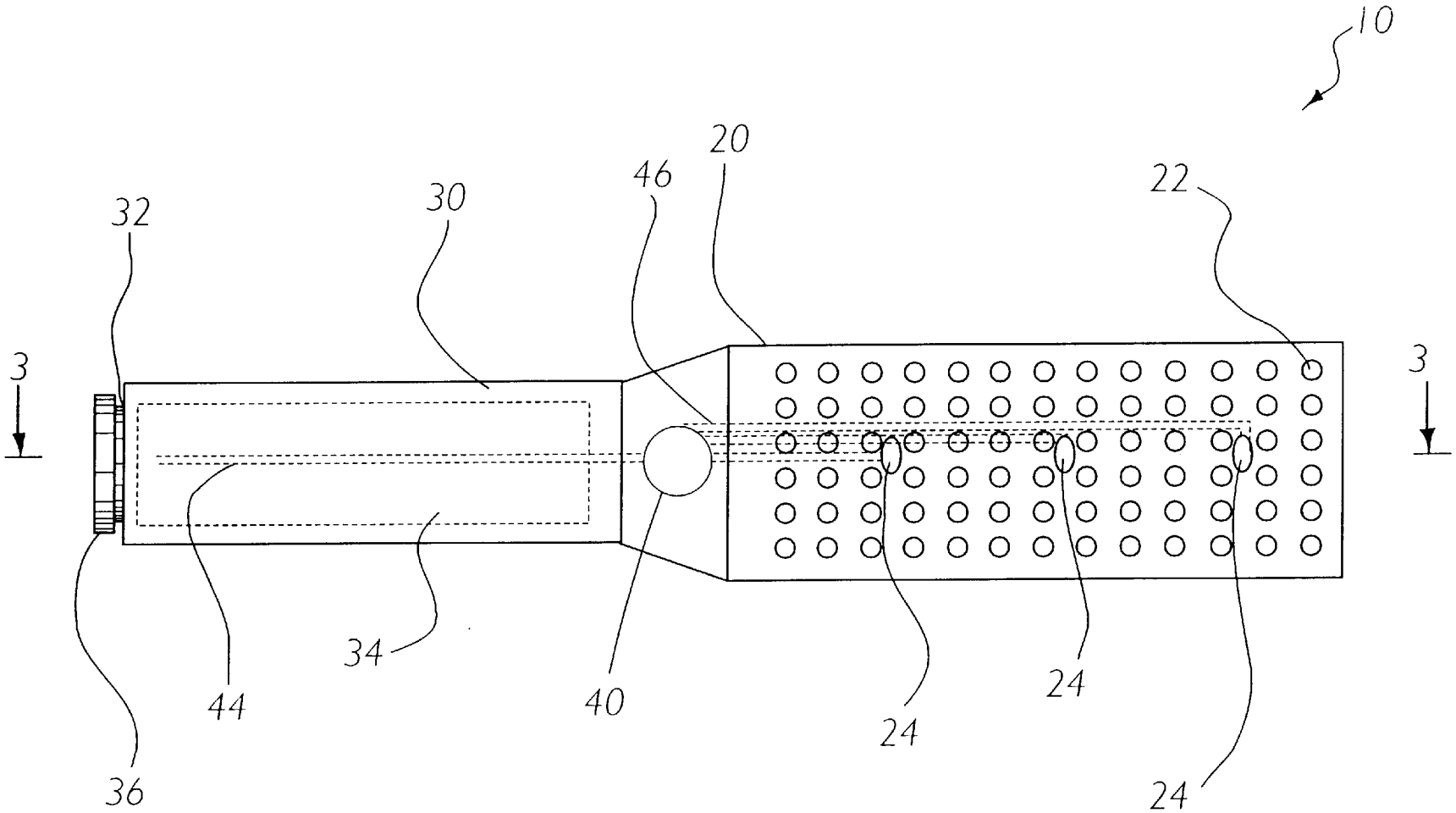
FIG. 2 is a bottom view of the present invention disclosing the bristles and nozzles.
Figure 3:
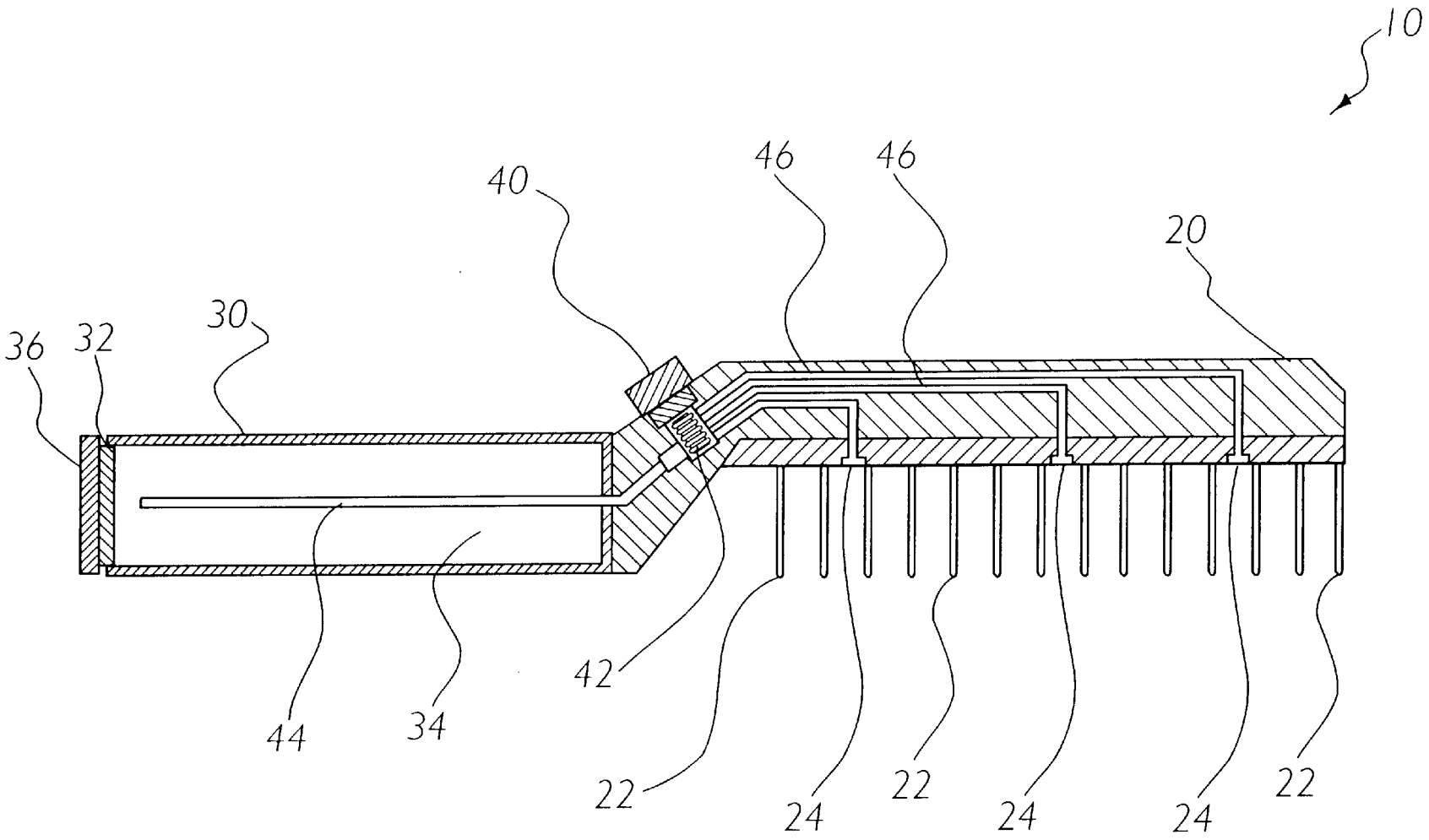
FIG. 3 is a cross sectional view taken along line 3—3 of FIG. 2 of the drawings.

As shown in FIG. 1 of the drawings, the handle 30 is connected to the head 20 substantially parallel to one another. The handle 30 is preferably cylindrical in shape while the head 20 is preferably swaged. As best shown in FIGS. 2 and 3 of the drawings, the plurality of bristles 22 extend from the head 20 portion as in a conventional brush. Preferably, the bristles 22 are aligned in rows a finite distance so as to allow free emission of the fluid without engaging the bristles 22. This allows the desired distribution of the fluid along the strands of hair of the user.

As best shown in FIG. 2 of the drawings, the nozzles 24 are positioned within the face of the head 20 securing the bristles 22. The nozzles 24 are preferably positioned between the aligned rows of bristles 22 as shown in FIGS. 2 and 3 of the drawings. This allows the emission of the fluid from the nozzles 24 with reduced engagement of the fluid with the bristles 22. This allows a complete distribution of the fluid upon the user's hair without accumulation of the fluid upon the bristles 22 which may break away in larger undesirable amounts.

As best shown in FIG. 3 of the drawings, the handle 30 includes an opening 32 opposite of the head 20. The opening 32 allows filling and cleaning of the chamber 34 within the handle 30. A threaded cap 36 threadably engages the handle 30 for selectively enclosing the opening 32 and the chamber 34 to prevent undesirable emission of the fluid within the chamber 34. The cap 36 is preferably smaller in size than the diameter of the handle 30 so as to not interfere with the use of the invention.

As best shown in FIGS. 1 and 3 of the drawings, the pump 42 is connected in the head 20 portion adjacent the handle 30. The pump 42 has a button 40 which is preferably located on the upper surface of the head 20 opposite of the bristles 22 to allow engagement by the user's thumb or other finger. As shown in FIG. 3 of the drawings, an intake tube 44 is fluidly connected to the chamber 34 and the pump 42. The intake tube 44 preferably extends into the chamber 34 so that the distal end is adjacent the cap 36, as shown in FIG. 3, to allow the pump 42 to draw the fluid when the fluid level is low.

As shown in FIG. 3 of the drawings, a plurality of delivery tubes 46 are fluidly connected between the pump 42 and the nozzles 24. The delivery tubes 46 extend within the head 20 as shown in FIG. 3 of the drawings.

In a first alternative embodiment, the pump has an electric motor 52 connected to it for allowing ease of operation. A battery supply 54 provides electricity to the electric motor which is operated by a button switch 50.

Figure 4:
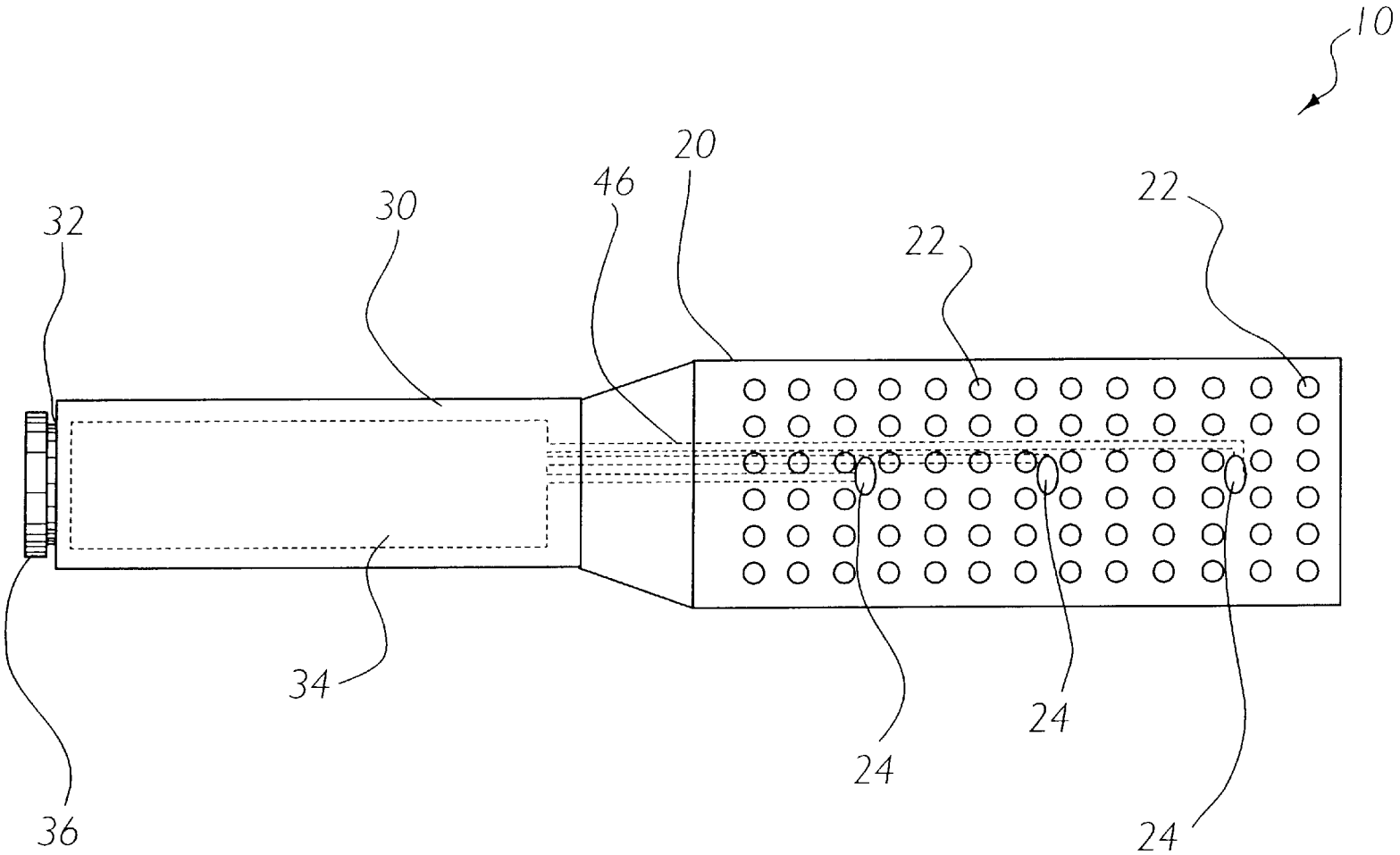
FIG. 4 is an alternative embodiment of the present invention disclosing a resilient handle with a chamber therewithin.
Figure 5:
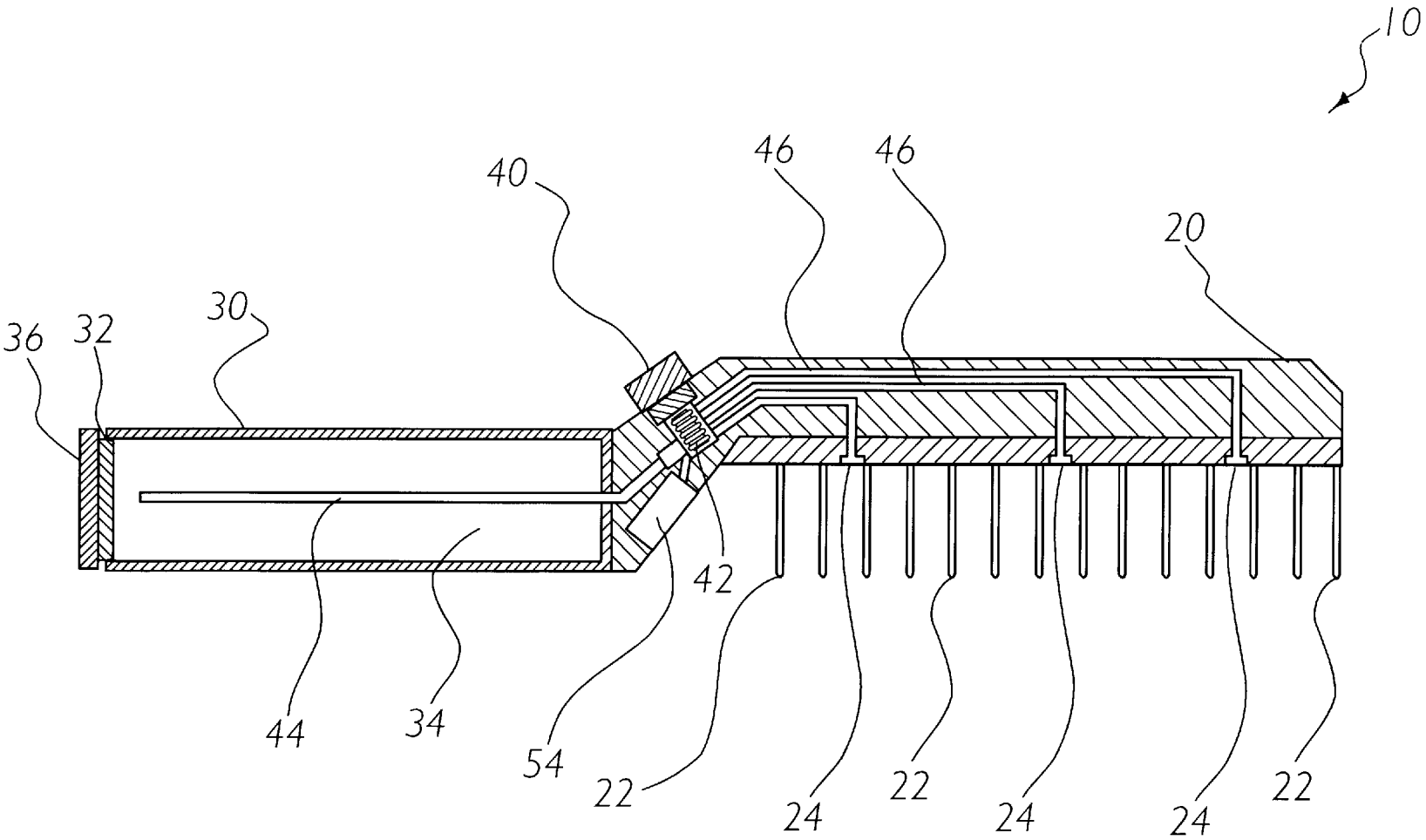
FIG. 5 is a cutaway view of an alternative embodiment of the present invention showing the electric pump, battery supply and button switch.

In a second alternative embodiment as shown in FIG. 4 of the drawings, the handle 30 is constructed of a resilient material, such as rubber, to allow the user to squeeze the handle 30. The squeezing of the handle 30 creates an internal pressure upon the fluid within the chamber 34 thereby forcing the fluid into the delivery tubes 46 attached to the chamber 34. The fluid thereafter flows outwardly from the nozzles 24 into the user's hair.

In use, the user utilizes the invention as a conventional hairbrush. After the user's hair is in the desired location and texture, the user engages the button 40 of the pump 42 so as to draw the fluid, such as hairspray, from the chamber 34. The fluid is then forced through the delivery tubes 46 where after it is emitted through the nozzles 24 in the head 20. The emitted fluid engages the user's hair including the base portion of the hair while the user is brushing their hair in the desired position and texture. The user may utilize a hairdryer simultaneously while brushing and applying the hairspray so as to immediately dry the hairspray upon the hair. When the user is finished, they may remove and clean any remaining hairspray within the chamber 34 to allow the invention to be utilized for applying another fluid such as gel or water.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination brush and hairspray system, comprising:

a handle;

a head attached to the handle, wherein said head includes a lower surface;

a plurality of bristles attached to said lower surface;

a chamber within said handle for containing a fluid;

a plurality of nozzles within said lower surface fluidly connected to said chamber by at least one tube;

a pump means positioned within said tube for drawing said fluid from said chamber and emitting said fluid through said plurality of nozzles;

said plurality of bristles are aligned in a plurality of rows; and said plurality of nozzles are positioned between said plurality of rows to allow complete distribution of said fluid without interference of said plurality of bristles.

2. The combination brush and hairspray system of claim 1, wherein said at least one tube comprises:

a plurality of delivery tubes fluidly connected to said electric pump opposite of said chamber and fluidly connected to said plurality of nozzles; and at least one intake tube fluidly connected to said electric pump and extending into said chamber a finite distance.

3. The combination brush and hairspray system of claim 2, wherein a distal end of said at least one intake tube is adjacent said cap.

4. A combination brush and hairspray system, comprising:

a handle;

a head attached to the handle, wherein said head includes a lower surface;

a plurality of bristles attached to said lower surface;

a chamber within said handle for containing a fluid;

at least one nozzle within said lower surface fluidly connected to said chamber by at least one tube;

a pump means positioned within said tube for drawing said fluid from said chamber and emitting said fluid through said at least one nozzle;

wherein said handle includes:

an opening opposite of said head; and a cap threadably engageable within said opening within said handle for allowing refilling and cleaning of said chamber;

said plurality of bristles are aligned in a plurality of rows;

said at least one nozzle is positioned between said plurality of rows to allow complete distribution of said fluid;

wherein said at least one nozzle comprises a plurality of nozzles aligned within said lower surface of said head, wherein said at least one tube comprises:

a plurality of delivery tubes fluidly connected to said pump opposite of said chamber and fluidly connected to said plurality of nozzles; and at least one intake tube fluidly connected to said pump and extending into said chamber a finite distance.

5. The combination brush and hairspray system of claim 4, wherein a distal end of said at least one intake tube is adjacent said cap.

6. The combination brush and hairspray system of claim 2, wherein said pump means comprises:

an electric pump;

a button switch positioned within said handle and electrically connected to said electric pump; and a battery supply positioned within said handle and electrically connected to said button switch.

7. The combination brush and hairspray system of claim 6, wherein a distal end of said at least one intake tube is adjacent said cap.

8. A combination brush and hairspray system, comprising:

a handle;

a head attached to the handle, wherein said head includes a lower surface;

a plurality of bristles attached to said lower surface;

a chamber within said handle for containing a fluid;

at least one nozzle within said lower surface fluidly connected to said chamber by at least one tube;

said handle is comprised of a resilient material for allowing a user to manually squeeze said handle thereby creating an internal pressure within said chamber;

wherein said handle includes:

an opening opposite of said head; and a cap threadably engageable within said opening within said handle for allowing refilling and cleaning of said chamber;

said plurality of bristles are aligned in a plurality of rows; and said at least one nozzle is positioned between said plurality of rows to allow complete distribution of said fluid;

wherein said at least one nozzle comprises a plurality of nozzles aligned within said lower surface of said head; and wherein said at least one tube comprises:

a plurality of delivery tubes fluidly connected to said pump opposite of said chamber and fluidly connected to said plurality of nozzles; and at least one intake tube fluidly connected to said pump and extending into said chamber a finite distance.

* * * * *